US009642445B2

(12) United States Patent
Cooke

(10) Patent No.: US 9,642,445 B2
(45) Date of Patent: May 9, 2017

(54) BACKPACK COT

(71) Applicant: Reid Cooke, Cleveland, NC (US)

(72) Inventor: Reid Cooke, Cleveland, NC (US)

( * ) Notice: Subject to any disclaimer, the term of this patent is extended or adjusted under 35 U.S.C. 154(b) by 0 days.

(21) Appl. No.: 14/923,718

(22) Filed: Oct. 27, 2015

(65) Prior Publication Data

US 2016/0113380 A1 Apr. 28, 2016

Related U.S. Application Data

(60) Provisional application No. 62/069,034, filed on Oct. 27, 2014.

(51) Int. Cl.

| | |
|---|---|
| ***A45C 15/00*** | (2006.01) |
| ***A45F 4/00*** | (2006.01) |
| ***A45F 4/02*** | (2006.01) |
| ***A45F 4/06*** | (2006.01) |
| ***A45F 4/10*** | (2006.01) |

(52) U.S. Cl.
CPC . *A45F 4/06* (2013.01); *A45F 4/10* (2013.01)

(58) Field of Classification Search
CPC ..... A45F 4/06; A45F 4/10; A45F 4/08
USPC ..... 224/575, 577, 153, 156
See application file for complete search history.

(56) References Cited

U.S. PATENT DOCUMENTS

| | | | | |
|---|---|---|---|---|
| 4,947,498 | A * | 8/1990 | Van Boxtel | A45F 4/06 224/155 |
| 5,439,405 | A * | 8/1995 | Storey | A45C 9/00 441/126 |
| 5,613,459 | A * | 3/1997 | Remy | B63B 35/731 114/242 |
| 6,135,635 | A * | 10/2000 | Miller | A47C 31/11 224/584 |
| 6,186,380 | B1 * | 2/2001 | Grounds | A45F 4/06 190/2 |
| 8,720,751 | B2 * | 5/2014 | Alsaffar | A45F 4/02 224/153 |
| 2007/0113338 | A1 * | 5/2007 | Remblad | A45F 4/06 5/420 |
| 2011/0231992 | A1 * | 9/2011 | Bernat | A45F 3/24 5/112 |

* cited by examiner

*Primary Examiner* — Brian D Nash
*Assistant Examiner* — Derek Battisti
(74) *Attorney, Agent, or Firm* — Shumaker, Loop & Kendrick, LLP

(57) ABSTRACT

Disclosed is a backpack cot, operating from a backpack position for hiking to a cot position for sleeping. The backpack cot has a frame. The frame includes a plurality of rigid members and a plurality of hinges for unfolding the backpack cot from the backpack position to the cot position. The backpack cot has a sleeping surface. The backpack cot also has a combination storage container and flotation device, for sealing contents of the container and for serving as a life preserver. The backpack cot may also have a carriage area for holding the storage container, a pair of shoulder straps, a waist belt, and a padded back which, together comprise the sleeping surface in the cot position.

3 Claims, 6 Drawing Sheets

BACKPACK COT

TECHNICAL FIELD AND BACKGROUND OF THE INVENTION

The present invention relates generally to the field of outdoor equipment and more particularly to the fields of backpacks and sleeping cots.

People have long carried loads on their backs as a means of more efficiently carrying loads from location to location. Over time, the backpack emerged as a means of carrying the loads. It is common for one carrying a load to require a respite from carrying the load in the form of a nap or sleeping, such as by night. Often, the person carrying the load will take the respite outdoors or otherwise away from the comforts of a bed. As such, he or she, whether with a sleeping bag or tent, must ultimate sleep on the ground. Sleeping on the ground can be uncomfortable for many reasons. First, the ground is hard and may not be level. Second, the ground may be wet or become wet with precipitation. Third, animals and insects as well as poisonous or undesirable plant life are typically located close to the ground. Thus, there is a need in the art of backpacking, hiking, and long distance travel for a device enabling comfortable respite of the traveler, at a location above the ground, which may be easily carried along with the load of the traveler.

Similarly, as with sleeping in the field of backpacking, hiking, and carrying loads outdoors, it is common in the art for articles in the load being carried to be negatively impacted by the elements. For instance, the load could become wet or damaged by precipitation, animals or insects could enter the backpack and damage articles inside. Similarly, articles in a backpack may have an odor or scent that may attract animals or insects. Thus, there is a need in the art for a backpack which seals the contents of the backpack from exposure to the elements.

When traversing terrain carrying a load as discussed, it is not uncommon for a hiker to encounter a situation where flotation is required. The hiker may have to ford a river, swim across a lake, save a drowning companion or stranger, or survive a sudden deluge of the elements. Accordingly, there is a need in the art for a backpack device which also functions as a flotation device.

SUMMARY OF THE INVENTION

It therefore is an object of the present invention to provide a backpack that includes a cot for sleeping. It is a further object of the present invention to provide a backpack that provides a sealed container for storage and carrying of the load. It is a further object of the present invention to provide a backpack which may serve as a flotation device. It is still a further object of the present invention to provide a backpack which provides a cot, a sealed container for storage and carrying of a load, and a flotation device.

These and other objects and advantages of the invention are achieved by a backpack cot, which unfolds into a cot for sleeping, having a sealable, removable, water tight storage container which may serve as a flotation device. The backpack cot unfolds from a backpack position to a cot position. The backpack cot has a frame which serves both as the frame for the cot and also as the frame for the backpack. A sleeping surface is attached to the frame. In the backpack position, the backpack may be attachable to a wearer via shoulder straps and a waist belt. The backpack may have a padded back portion which functions with the waist belt and the shoulder straps to aid in carrying a load. In the cot position, the straps, the waist belt, and the padded back portion may form all or a portion of the sleeping surface. The frame of the backpack cot includes a plurality of hinged connections which unfold as the backpack cot moves from the backpack position to the cot position.

According to one embodiment of the invention, the storage container is made from plastic, has a rectangular shape and has as removable, sealable lid.

According to an embodiment of the invention, the backpack cot has a carriage area which accommodates the storage container. The carriage area may be made of a cloth material and may function as a carriage area in the backpack position and as a portion of the sleeping surface in the cot position. The carriage area may conform to the shape of the storage container in the backpack position and be substantially planar in the cot position.

According to another embodiment of the invention, the frame is made of aluminum.

According to another embodiment of the invention, the frame has a plurality of legs which unfold in the cot position so that the frame and the sleeping surface are elevated above the ground.

According to another embodiment of the invention, the legs of the frame have runners.

BRIEF DESCRIPTIONS OF THE DRAWINGS FIGURES

The present invention is best understood when the following detailed description of the invention is read with reference to the accompanying drawings in which.

DETAILED DESCRIPTION OF THE PREFERRED EMBODIMENT

It is to be understood by a person having ordinary skill in the art that the present discussion is a description of exemplary embodiments only and is not intended as limiting the broader aspects of the present invention. The following example is provided to further illustrate the invention and is not to be construed to unduly limit the scope of the invention.

Figure 1:
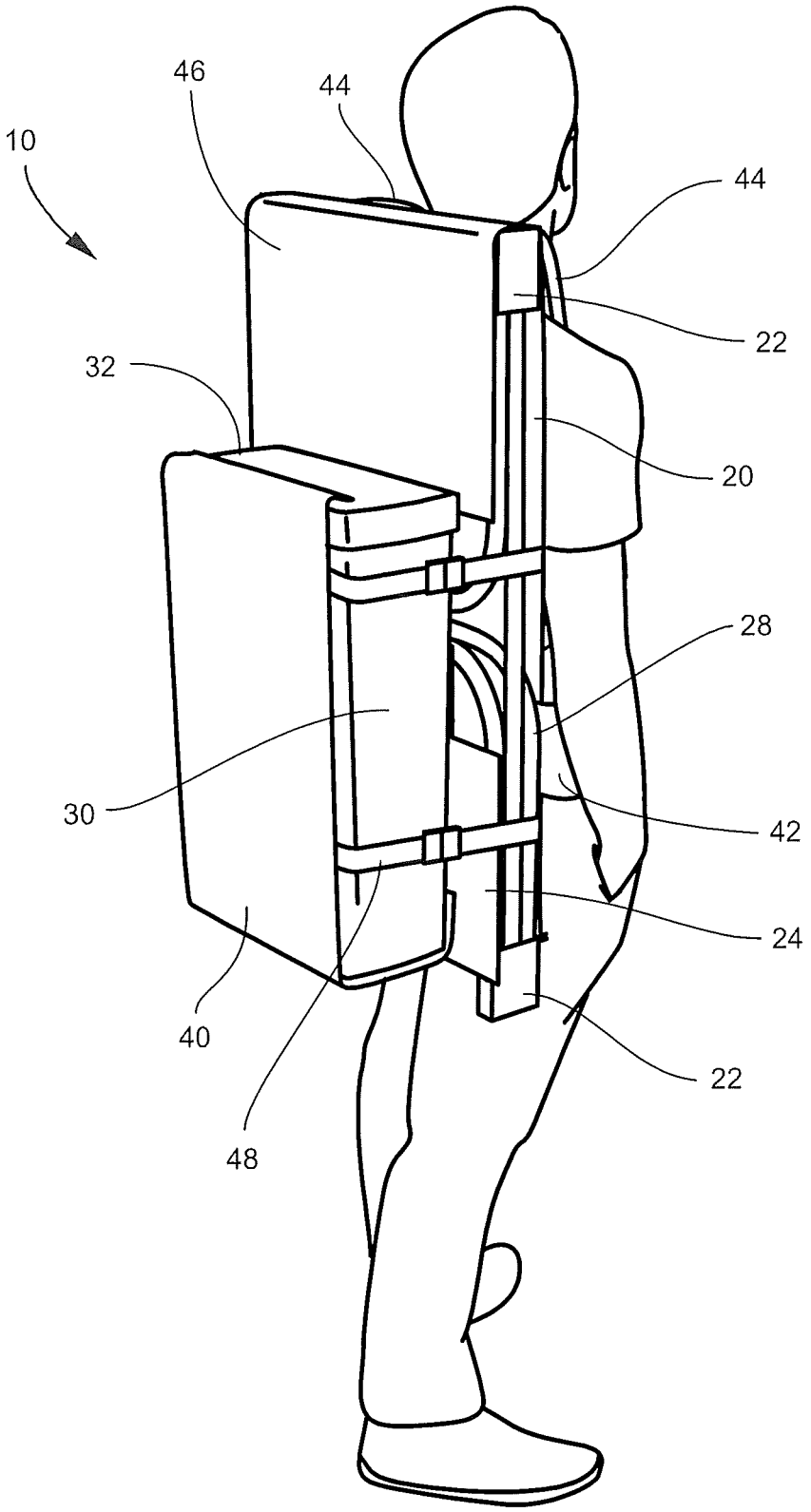
FIG. 1 is a perspective view of the backpack cot in the backpack position.
Figure 2:
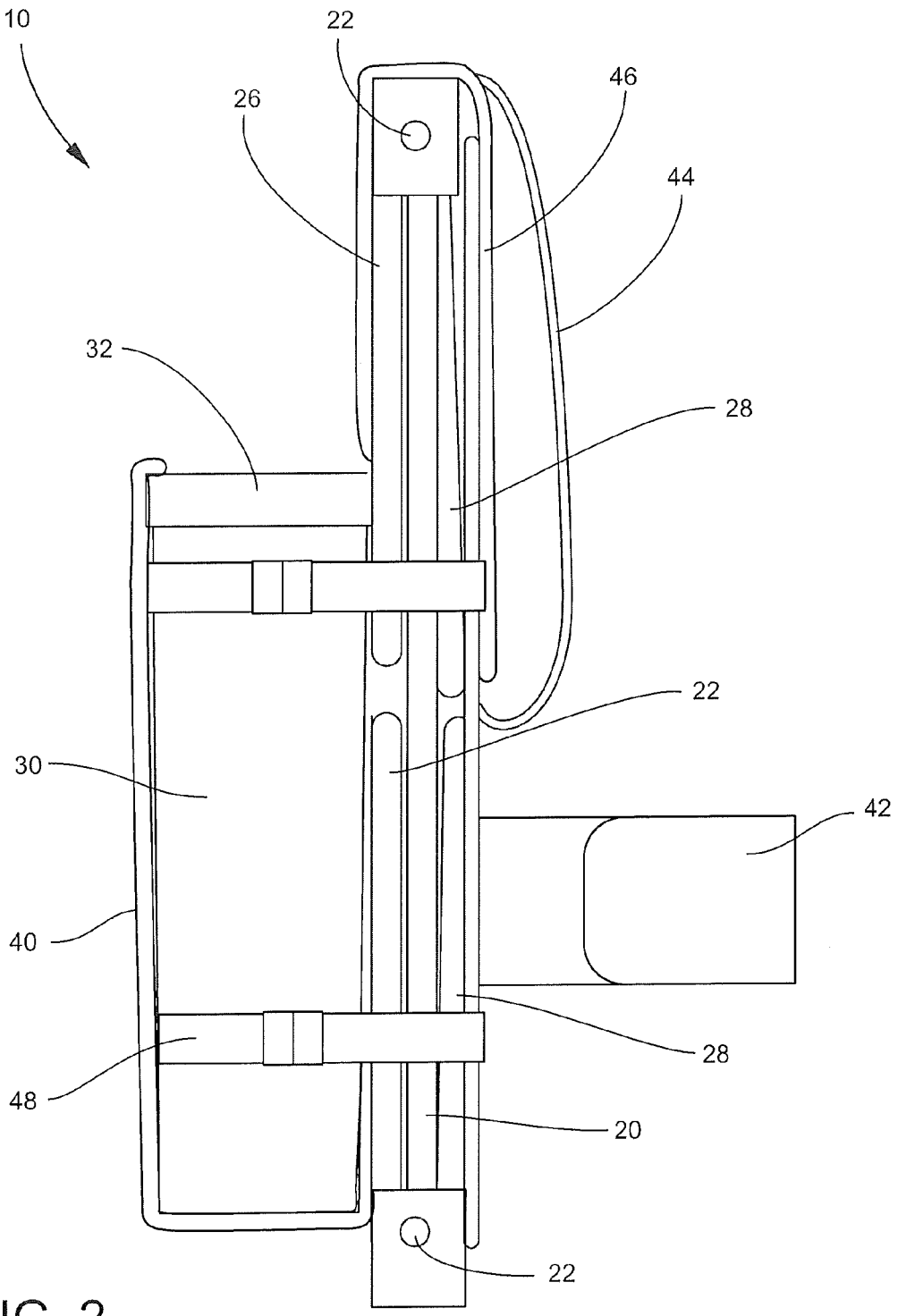
FIG. 2 is a side view of the backpack cot in the backpack position.
Figure 3:
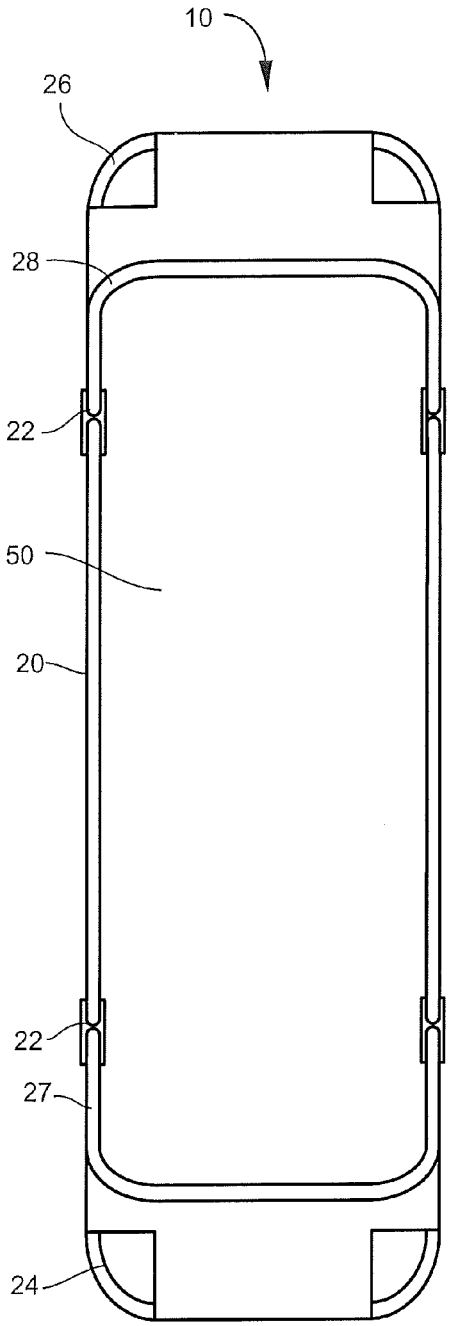
FIG. 3 is a bottom view of the backpack cot in the cot position.
Figure 4:
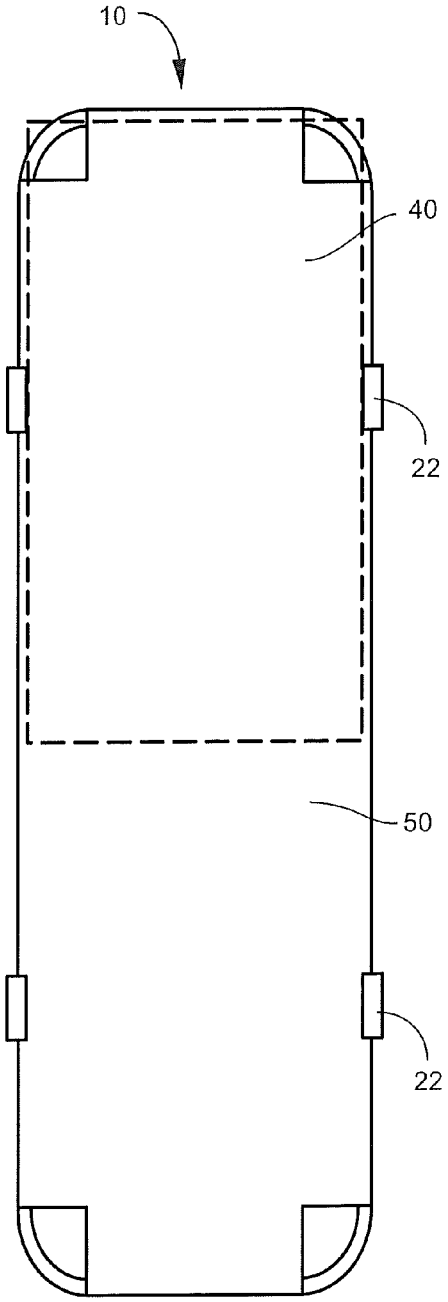
FIG. 4 is a top view of the backpack cot in the cot position.
Figure 5:
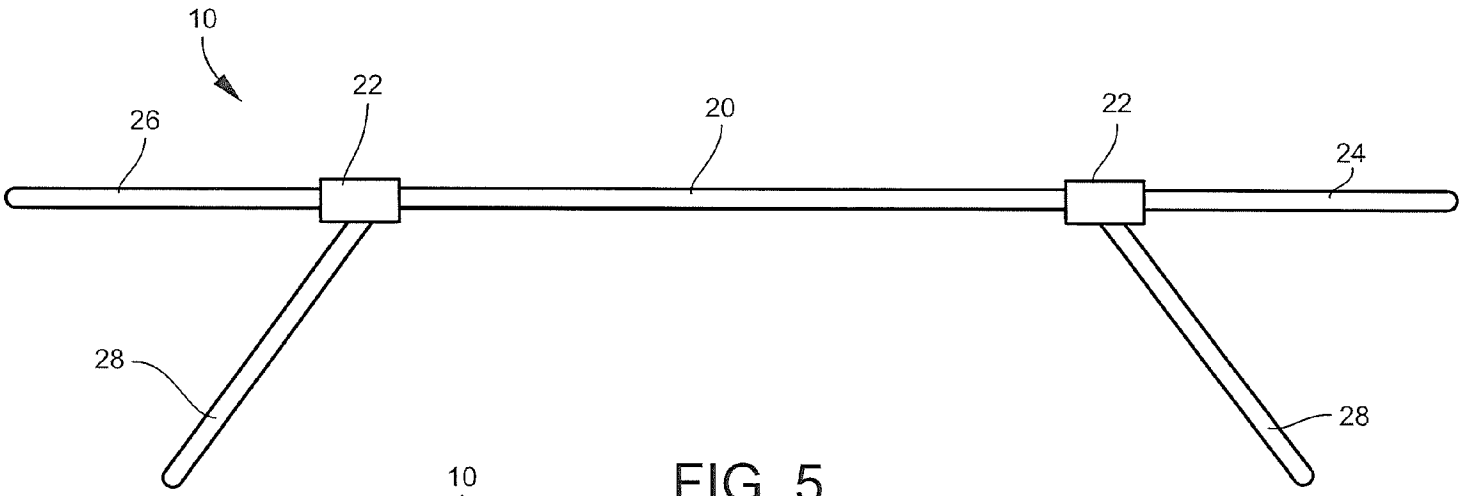
FIG. 5 is a side view of one embodiment of the backpack cot in the cot position.

Referring to FIGS. 1-2, the invention is a backpack cot 10. The backpack cot 10 is designed to operate from a backpack position as shown in FIGS. 1-2 and also in a cot position as shown FIGS. 3-7. The backpack cot 10 unfolds as shown in FIGS. 8A-8E to form a sleeping surface 50.

The backpack cot 10 has a frame 20. Preferably the frame is made from aluminum but it may be made from any metal, wood, or plastic. The frame has a head portion 26 and a foot portion 24. The head and foot portions are preferably attached to the main body of the frame via hinges 22. The frame also has legs 28 which are also attached via hinges 22.

In the backpack position of FIGS. 1-2, the head and foot portions 24, 26 of the frame 20 are folded to serve as the frame for the backpack for the purposes of carrying a load. Straps 44 attach the frame to the back of a human user. A waist belt 42 attaches around the waist of a wearer and to the frame 20 for aiding in carrying the backpack and the load. The frame 20 also has a padded back 46 which extends over the top of the frame at the head portion 26 of the frame 20. The padded back may provide the user comfort when carrying the backpack cot 10 in the backpack position of FIGS. 1-2.

In the backpack position of FIGS. 1-2, the backpack cot 10 includes a water tight sealed storage container 30. The water tight sealed storage container 30 may carry items needed by the user such as food, a sleeping bag, a tent, weapons, etc., and other items that may be needed by a hiker. The storage container 30 may also serve as a flotation device. The storage container 30 is preferably made from plastic. The storage container has a lid 32 which forms the water tight seal of the container 30.

The storage container 30 is carried by the frame 20 via a carriage area 40. The carriage area 40 is preferably made from a lightweight fabric. Side straps 48 may help hold the storage container 30 in the carriage area 40.

Figure 6:
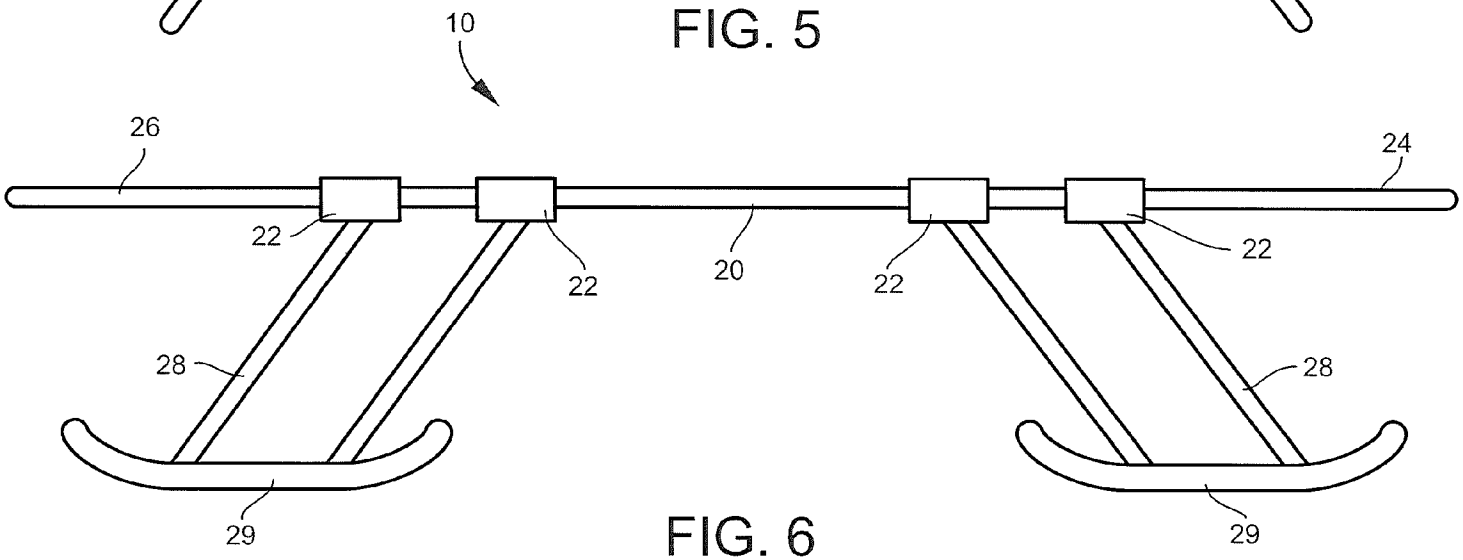
FIG. 6 is a side view of one embodiment of the backpack cot in the cot position.
Figure 7:
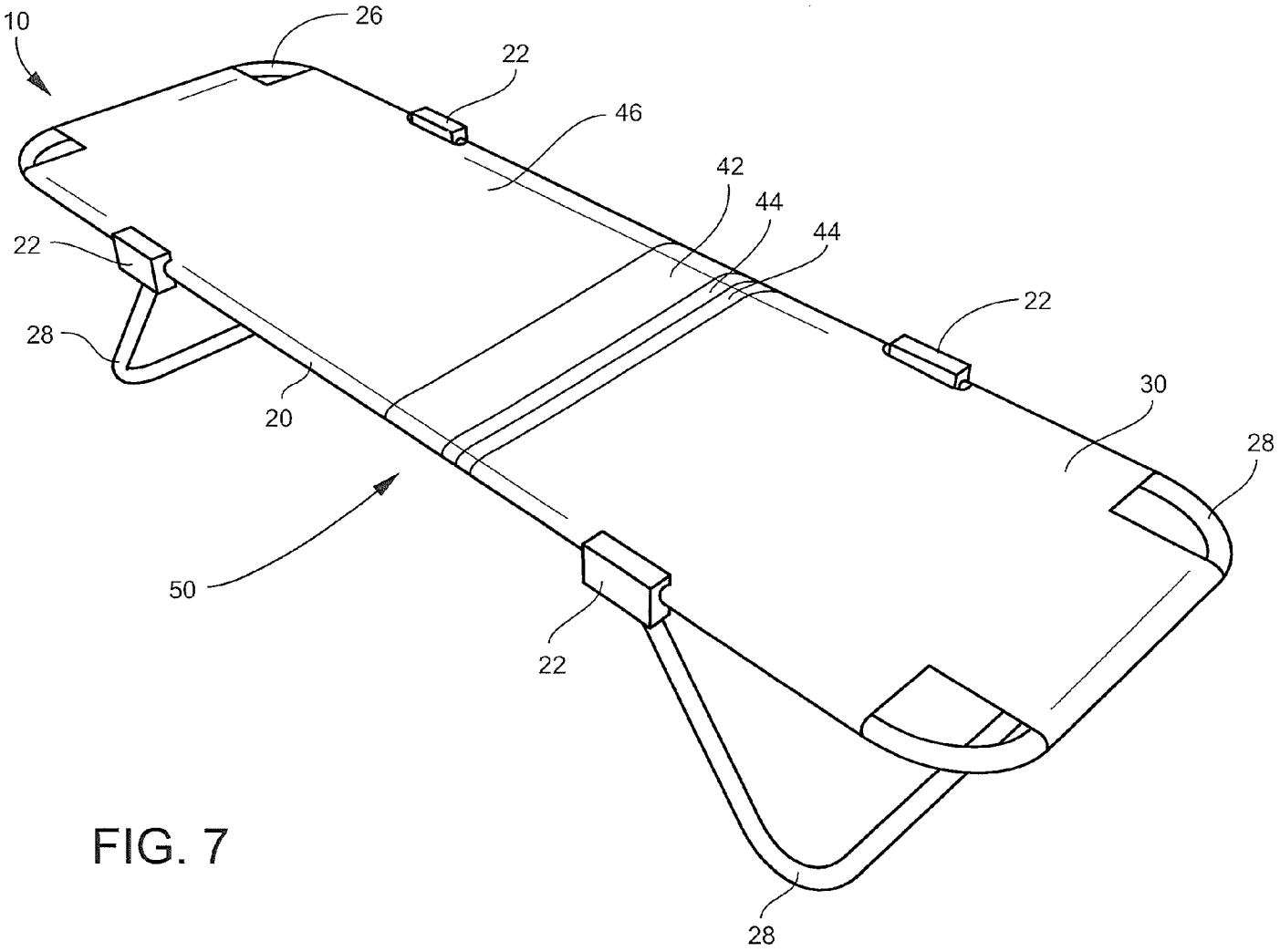
FIG. 7 is a perspective view of the backpack cot in the cot position.
Figures 8A, 8B, 8C, 8D, 8E:
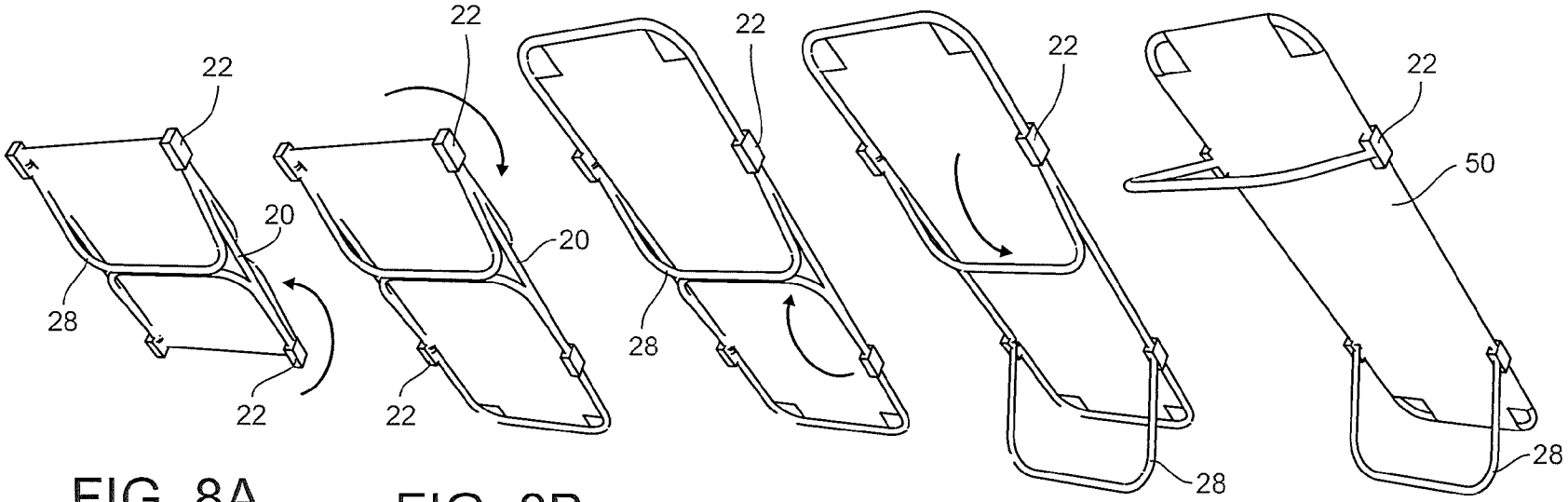
FIGS. 8A-8E are perspective views of the backpack cot illustrating the unfolding from backpack position to the cot position.

When the backpack cot 10 is unfolded from the backpack position of FIGS. 1-2 to the cot position of FIGS. 3-7 the storage container 30 is set aside. The storage container 30 may contain a hook (not shown) so that the container may be suspended from a tree. As the backpack cot 10 is unfolded, the frame 20 is unfolded at hinges 22. Head portion 26 and foot portion 24 unfold as do the legs 28. A sleeping surface 50 is spread across the frame 20. The sleeping surface 50 may be a solid piece of fabric or the sleeping surface may be made from one or more portions of the backpack cot 10 which formed the backpack position of the backpack cot. For instance, as shown in FIG. 7, the sleeping surface 50 may be formed from carriage area 30, the shoulder straps 44, the waist belt 42, and the padded back 46. As shown in FIG. 7, the padded back forms the head portion 26 of the backpack cot 10. The waist belt 42 and the shoulder straps 44 form a central portion and the carriage area 30 forms the foot portion 24. These various elements, namely the padded back 46, the shoulder straps 44, the waist belt 42, and the carriage area 30, may form the sleeping surface 50 and may be attached to the frame 20. The attachment may be the same form of attachment as in the backpack position, such as by sewn connection around the frame 20. Or the attachment may be removable and reconfigurable as the backpack cot is unfolded from the backpack position to the cot position. Such an attachment may be via buttons, snaps, hook and loop fasteners, straps, magnets, and the like.

An alternate configuration of the legs 28 of the backpack cot 10 is shown in FIG. 6. Here, the legs 28 further include runners 29.

A backpack cot 10 according to the invention has been described with reference to specific embodiments and examples. Various details of the invention may be changed without departing from the scope of the invention. Furthermore, the foregoing description of the preferred embodiments of the invention and best mode for practicing the invention are provided for the purpose of illustration only and not for the purpose of limitation, the invention being defined by the claims.

What is claimed is:

1. A backpack cot, operating from a backpack position for hiking to a cot position for sleeping, comprising:

a frame having a plurality of rigid members and a plurality of hinges for unfolding the backpack cot from the backpack position to the cot position;

a sleeping surface;

a rigid, non-deflatable, storage container, for sealing contents of the storage container and for serving as a life preserver, having a water tight seal and having a buoyancy that is capable of supporting a person above water and characterized by a lack of any separate storage container which itself does not serve as a life preserver;

a carriage area attached to the frame, conforming to the shape of the storage container in the backpack position;

a pair of shoulder straps and a waist belt, for carrying the frame by a user in the backpack position; and a padded back for providing comfort to a user in the backpack position;

wherein, in the cot position, the padded back forms a head portion of the sleeping surface, the waist belt and the shoulder straps form a central portion of the sleeping surface, the carriage area forms a foot portion of the sleeping surface, and together, the head portion of the sleeping surface, the central portion of the sleeping surface and the foot portion of the sleeping surface form an uninterrupted contiguous sleeping surface;

wherein the carriage area, the shoulder straps, the waist belt, and the padded back are made from a lightweight fabric.

2. The backpack cot of claim 1 wherein the frame is made of aluminum.

3. The backpack cot of claim 1 wherein the plurality of rigid members and the plurality of hinges further comprises:

a central frame;

a head frame portion hingedly attached to the central frame by a first hinge;

a foot frame portion hingedly attached to the central frames by a second hinge;

a first pair of legs hingedly attached to the central frame by the first hinge; and a second pair of legs hingedly attached to the central frame by the second hinge.

* * * * *